United States Patent [19]

Cianflone

[11] 4,346,517

[45] Aug. 31, 1982

[54] MUSTACHE TRIMMER

[76] Inventor: Robert A. Cianflone, 885 Lovingston Dr., Pittsburgh, Pa. 15216

[21] Appl. No.: 197,081

[22] Filed: Oct. 15, 1980

[51] Int. Cl.[3] ..... B26B 21/00

[52] U.S. Cl. ..... 30/49; 30/90

[58] Field of Search ..... 30/49, 77, 90, 29.5, 30/30

[56] References Cited

U.S. PATENT DOCUMENTS

| | | | |
|---|---|---|---|
| 1,792,415 | 2/1931 | Dean | 30/49 |
| 1,974,568 | 9/1934 | Grotenhuis | 30/29.5 |
| 2,259,996 | 10/1941 | Brant | 30/49 |
| 2,598,711 | 6/1952 | Musso | 30/49 |
| 3,172,202 | 3/1965 | Sooter | 30/90 |
| 3,465,436 | 9/1969 | Musso | 30/49 |

FOREIGN PATENT DOCUMENTS

| | | | |
|---|---|---|---|
| 429868 | 6/1935 | United Kingdom | 30/49 |

*Primary Examiner*—Jimmy C. Peters

*Attorney, Agent, or Firm*—Webb, Burden, Robinson & Webb

[57] ABSTRACT

This invention pertains to a mustache trimmer have a 360° circular cutting edge. The trimmer comprises an annular holder and an annular razor blade telescoped into said holder with the cutting edge of the razor blade exposed.

13 Claims, 4 Drawing Figures

MUSTACHE TRIMMER

BACKGROUND

Substantially every apparatus for trimming mustaches with a cutting edge of which the applicant is aware involves a straight or almost straight cutting edge. The closest related prior art of which the applicant is aware is Saavedra et al. U.S. Pat. No. 3,066,413 in which the blade is provided with a slight curvature. According to my invention, I provide a radical departure from prior art razors and mustache trimmers wherein a 360° circular cutting edge is provided. The diameter of the cutting edge is between about one and two inches. I have found that this cutting edge provides for extremely accurate and safe mustache trimming.

SUMMARY OF THE INVENTION

Briefly according to this invention, there is provided a mustache trimmer comprising an annular holder and an annular razor blade telescoped into said holder. The razor blade is arranged with an exposed 360° circular cutting edge extending away from the annular holder. Preferably the holder has a radial face preventing access to the cutting edge of the razor blade from one axial end of the holder. The blade may comprise one unitary permanently fixed high quality steel blade or it may, for example, comprise two or more standard safety blades of the two-edge flexible type. The circular cutting edge should have a diameter between about one and two inches.

According to a preferred embodiment, the outer cylindrical surface of the holder, which may be made of plastic material, has a serrated cylindrical surface to improve the user's grip upon the holder. The holder may be sized to receive two or more standard flexible double edge razor blades. In this event, apparatus must be provided for securing the blades in place. According to one embodiment, the holder has a cylindrical plug insert which may be placed inside of the blade and which may be secured to the holder. One method of securing the plug insert to the holder is to provide a threaded extension of the insert for engaging a threaded bore in an axial end face of the holder. A more elaborate apparatus for securing the blades in place comprises presser feet which are pivoted to a radial end face and are actuated against the inside surface of the blades by cam action.

It is preferred that the blade be exposed no more than about 1/16of an inch above the holder. Preferably the outer edge of the holder near the blade is beveled toward the cutting edge. Preferably the bevel comprises a conical surface, the extension of which passes near or through the cutting edge of the blade. The conical angle may be between about 20 and 50 degrees. In a preferred embodiment, a cylindrical cap is arranged to be placed over the blade and is, for example, slidably secured to the holder to protect the blade when it is not in use. The cap should have openings therein so that drying air may circulate past the blade when it is not in use.

THE DRAWINGS

Further features and other objects and advantages of this invention will become clear from the following detailed description made with reference to the drawings, in which FIG. 1 is a perspective of a mustache trimmer according to this invention, FIG. 2 is a top view of a mustache trimmer according to this invention, FIG. 3 is a side view in section of a mustache trimmer according to this invention with a protective cap secured thereon, and FIG. 4 is a top view of a mustache trimmer according to this invention in which cam actuated presser feet hold the removable blades in place.

DETAILED DESCRIPTION

Figure 1:
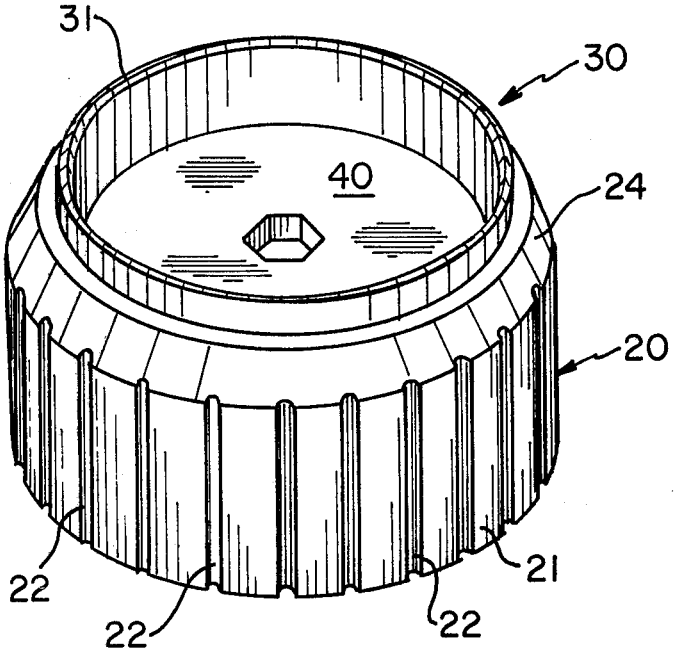

Referring now to FIG. 1, there is illustrated a mustache trimmer comprising a holder 20 having a cylindrical outer surface 21 with serrations 22 on the outer cylindrical face thereof. Not visible is a radial end face of the holder. Inserted within the holder, is a cylindrical razor blade 30 having a 360° circular cutting edge 31. The razor extends slightly above the beveled conical edge surface 24 of the holder 20. A plug 40 is shown inserted within the inner surface of the cylindrical razor blade. The plug is secured by threads not shown into the radial end face of the holder.

Figure 2:
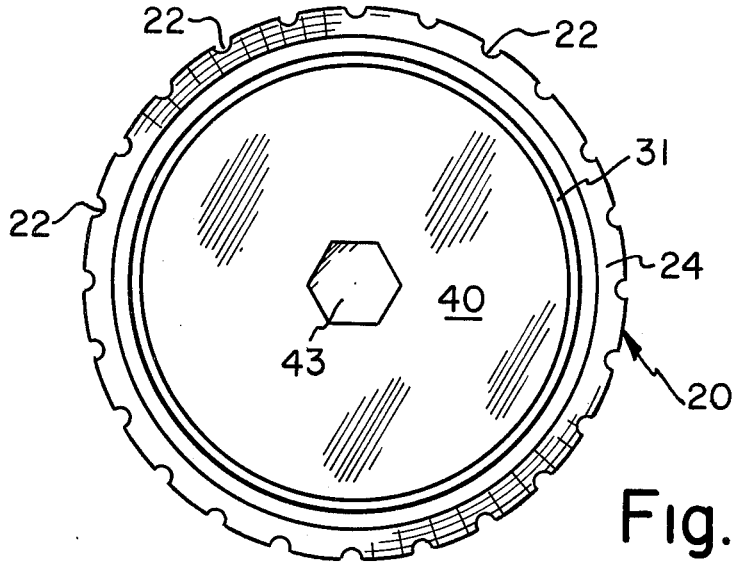

Referring now to FIG. 2, there is shown a top view of the mustache trimmer illustrated in FIG. 1. The numbers of the elements illustrated in FIG. 2 correspond directly to those described with reference to FIG. 1.

Figure 3:
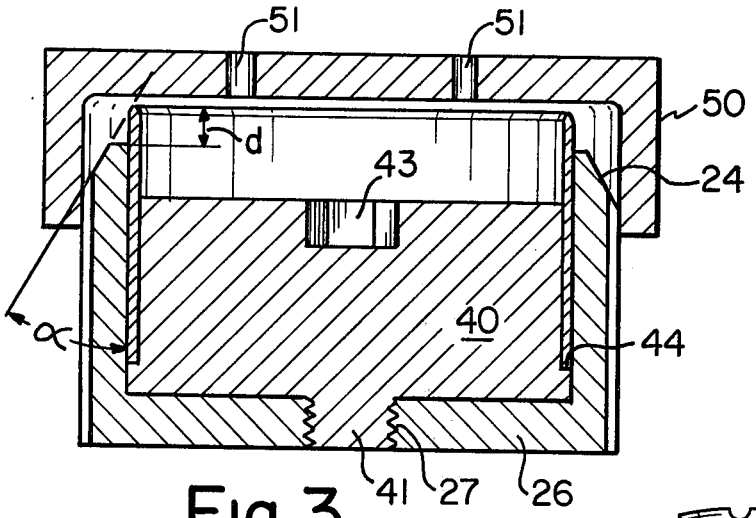

Referring now to FIG. 3 there is shown, in section, the mustache trimmer as shown in FIGS. 1 and 2. The section is through the cylindrical axis of the holder 22. Note that the plug 40 has an extension 41 which has external threads thereon. The radial end face 26 of the holder 20 is shown in section. The end face has a bore 27 with internal threads therein. Thus the plug 40 may be secured within the cylindrical holder by threading the two together. As shown in FIG. 3, the plug 40 has a cylindrical flange 43 upon which one edge of the cylindrical razor blade rests. Thus when the plug is turned out of the holder, the blade is also drawn out of the holder providing a safe means of withdrawing the blade from the holder. A socket 44 is arranged to receive an Allen wrench to turn the plug.

A cap 50 is illustrated in section in FIG. 3. The cap fits over the cutting edge of the mustache trimmer to protect the razor edge when not in use. Note that the cap 50 is provided with openings 51 which enable air to circulate past the razor edge when the blade is not in use. This insures that the blade will dry if it is rinsed after use.

Referring again to FIG. 3, the section view illustrates the bevel on the end 24 of the holder 20. The beveled surface 24 comprises a conical surface having an extension which passes near or through the cutting edge. The conical angle $\alpha$ is preferably between 20 and 50 degrees. The cylindrical blade extends a distance d above the end of the holder, which distance is preferably 1/16th of an inch.

Figure 4:
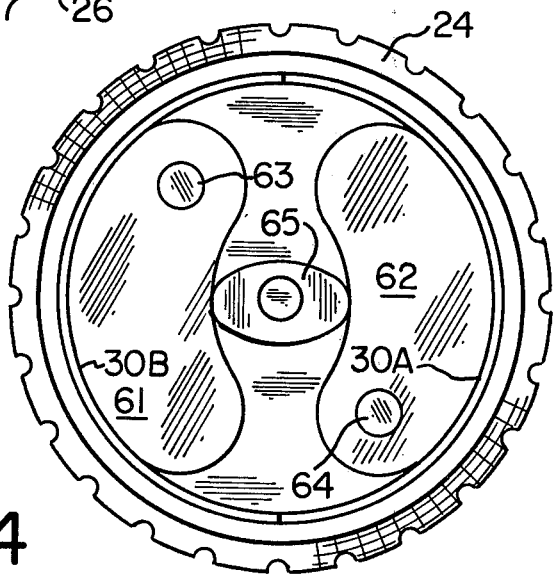

Referring now to FIG. 4, there is shown an alternate embodiment of this invention. The numerals identifying elements on FIG. 4 correspond directly to related elements on FIGS. 1 to 3. In this embodiment, the blade comprises two standard safety razor blades 30A and 30B. The blades are held in place by presser feet 61 and 62 which are pivoted to the radial end wall 26 at 63 and 64. A cam 65 is rotatably mounted in the radial end wall 26 and may be turned to force the presser feet out against the blades 30A and 30B.

Having thus described the invention with the detail and particularity required by the patent laws, what is desired protected by Letters Patent is set forth in the following claims.

I claim:

1. A mustache trimmer comprising an annular holder having an inner cylindrical surface and a cylindrical razor blade telescoped into said holder adjacent said inner cylindrical surface of said holder, said blade having a circular cutting edge facing away from said holder along the axis of the annular holder, said cutting edge extending from said holder so as not to be obstructed from one axial end, said holder having a radial face preventing access to the razor blade from the other axial end, the outer edge of the holder nearest the cutting edge of the blade being beveled toward said cutting edge.

2. A mustache trimmer according to claim 1 wherein the blade is removably secured in said holder.

3. A mustache trimmer according to claim 1 wherein the diameter of the cutting edge is between about one and two inches.

4. A mustache trimmer according to claim 1 wherein the holder has an outer cylindrical surface.

5. A mustache trimmer according to claim 1 wherein the beveled edge of the holder is a conical surface the extension of which passes near or through the cutting edge of the blade.

6. A mustache trimmer according to claim 5 wherein the conical angle of the conical surface is between 20 and 50 degrees.

7. A mustache trimmer comprising an annular holder having an inner cylindrical surface and razor blade telescoped into said holder adjacent said inner cylindrical surface of said holder, said blade having a 360° circular cutting edge extending away from said holder, said cutting edge extending from said holder so as not to be obstructed, said holder sized to receive at least two standard flexible razor blades which together comprise the annular razor blade.

8. A mustache trimmer according to claim 7 wherein a cylindrical insert plug may be placed inside of the blades and secured to the holder for holding the blades within the holder.

9. A mustache trimmer according to claim 8 wherein the insert plug is threaded into the radial end face of the holder.

10. A mustache trimmer according to claim 7 wherein the holder has two hinged presser feet that are cam actuated to hold the blade in place.

11. The mustache trimmer according to claims 1 or 7 having a cap that fits over the blade when the trimmer is not in use.

12. A mustache trimmer according to claim 11 wherein the cap is vented to provide for drying of the blade when the cap is in place.

13. A mustache trimmer according to claims 1 or 7 wherein the blade is exposed above the holder no more than about 1/16th of an inch.

* * * * *